US006111212A

United States Patent [19]

DuPont et al.

[11] Patent Number: 6,111,212

[45] **Date of Patent: *Aug. 29, 2000**

[54] INTERRUPT ASSEMBLY FOR A PRIMARY CIRCUIT BREAKER

[75] Inventors: John Phillip DuPont; Todd Kim Knapp, both of Waukesha, Wis.

[73] Assignee: Cooper Industries, Inc., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/063,272

[22] Filed: Apr. 21, 1998

[51] Int. Cl.[7] ..... H01H 33/76

[52] U.S. Cl. ..... 218/90; 218/154

[58] Field of Search ..... 218/90, 91, 92, 218/154

[56] References Cited

U.S. PATENT DOCUMENTS

| | | | |
|---|---|---|---|
| 2,095,729 | 10/1937 | Beiersdorf . | |
| 3,183,331 | 5/1965 | Barkan | 218/90 |
| 4,307,369 | 12/1981 | Jackson, Jr. | 337/282 |
| 4,435,690 | 3/1984 | Link et al. . | |
| 4,591,816 | 5/1986 | Mikulecky et al. . | |
| 4,604,508 | 8/1986 | Talpo | 200/148 R |
| 4,611,189 | 9/1986 | Mikulecky . | |
| 4,684,773 | 8/1987 | Niemeyer | 218/90 |

FOREIGN PATENT DOCUMENTS

| | | |
|---|---|---|
| 375062A | 3/1964 | France . |
| 883467 | 7/1953 | Germany . |
| 1112164 | 8/1961 | Germany . |
| 1127444 | 4/1962 | Germany . |
| 887260 | 1/1962 | United Kingdom . |

*Primary Examiner*—Lincoln Donovan
*Attorney, Agent, or Firm*—Fish & Richardson PC

[57] ABSTRACT

An interrupt assembly for a primary circuit breaker of a distribution transformer includes an elongated housing that is divided into separate chambers for holding insulating fluid that extinguish an arc generated when a high-voltage electrical path between two breaker contacts is broken. The elongated housing includes openings that allow for the rapid exit of the expanding gases generated as a result of the arc. Consequently, the separately held insulating fluid in each chamber presents a strong dielectric property to the arc, causing it to extinguish rapidly.

30 Claims, 7 Drawing Sheets

INTERRUPT ASSEMBLY FOR A PRIMARY CIRCUIT BREAKER

TECHNICAL FIELD

The present invention generally relates to the field of interrupt assemblies, and more particularly to an interrupt assembly for a circuit breaker used with a distribution transformer.

BACKGROUND

Distribution transformers, which step down a substantially high voltage, in the range of 2400 volts to 21000 volts, to a relatively low voltage, in the range of 120 to 240 volts, are used extensively for distributing electrical power within a service area. These transformers operate by applying the substantially high voltage to a primary winding at a primary side, thereby producing the relatively low voltage on a secondary winding at a secondary side. During operation, however, the distribution transformers are constantly exposed to fault conditions, for example, conditions caused by shorts across distributions lines, internal shorts, or overheating. If not protected, the fault conditions, which are usually manifested by increased heat, may damage or even destroy a distribution transformer.

In order to protect the transformers, fault sensing circuit breakers are widely employed in the power industry. Upon detecting a fault condition, for example, based on a sensed temperature, a circuit breaker isolates the transformer from other power circuitry by breaking a faulty path between two serially connected breaker contacts. Most circuit breakers used in the power industry are secondary circuit breakers, which isolate the secondary side of the transformer. For example, one known conventional secondary circuit breaker incorporates a bi-metal that upon exposure to increased heat bends to break the faulty path. The secondary circuit breakers are, however, inefficient. This inefficiency is largely due to the impedance a secondary circuit breaker presents to the flow of a substantially high current, which is produced at the secondary side by stepping down the substantially high voltage applied to the primary side.

In order to reduce the inefficiency associated with the secondary circuit breakers, primary circuit breakers, which isolate the primary side of a transformer, have been used. Because of a low current flow on the primary side, a primary circuit breaker dissipates much less energy than a secondary circuit breaker. However, unlike the secondary circuit breaker, which breaks a low-voltage path, the primary circuit breaker must break a substantially high-voltage path, i.e., a path with a voltage in the range of 2400 volts to 21,000 volts. When such a high-voltage path is broken, an arc is generated having a length proportional to the voltage level of the broken path.

For safety reasons, the generated arc must be extinguished as rapidly as possible. As a result, conventional primary circuit breakers are equipped with an arc-extinguishing chamber that is immersed in an insulating fluid, also known as transformer oil, which has a dielectric property formulated for extinguishing the arc. While extinguishing the arc, however, the heat produced by the arc breaks the insulating fluid into an expanding gaseous state that must be dissipated to prevent pressure built up in the chamber and a possible circuit breaker explosion.

FIG. 1 shows a cross sectional view of a conventional primary circuit breaker 10, which is disclosed in U.S. Pat. Nos. 4,435,690, 4,611,189, and 4,591,816. The circuit breaker 10 includes an interrupt assembly 12 that is actuated by an external latch mechanism 14 for closing and opening the electrical path between two breaker contacts 16. The circuit breaker 10 is tripped by a temperature sensing device 18, which is responsive to an increase in temperature due to a fault condition. The interrupt assembly 12 includes a central core 20 formed of a molded arc extinguishing material which is enclosed within a glass reinforced plastic sleeve 22. The core 20 includes an elongated bore 24 that is integrated with a circular base 26 at the bottom and a circular cap 28 at the top. The electrical path between the first and second circuit breaker contacts 16 is opened and closed by a conductive rod 30 that under the control of the latch mechanism 14, moves reciprocally within the elongated bore 24.

Under the arrangement of FIG. 1, the space between the base 26 and the cap 28 defines a single arc-chamber 32, which is open to the elongated bore 24 through a number of openings 34. The openings 34, which are disposed along the length of the bore 24, allow the insulating fluid to dielectrically insulate the path of the conductive rod 30 as it travels downward along the core 20. As a result, the generated gases can expand into the arc-chamber 32 and remain confined within the surrounding walls provided by the sleeve 22. A relief port 36 is provided on the cap 28 for the discharge of oil and/or gases from the arc-chamber 32. The port 36 also operates as an entry port for the insulating fluid, allowing it to enter into the arc-chamber 32, when the circuit breaker 10 is immersed into the insulating fluid.

However, it is desirable to reduce the size and manufacturing cost of the conventional primary circuit breaker of FIG. 1. By reducing the size of the circuit breaker, a shorter fluid tank with less fluid may be used for immersing the circuit breaker. Also, a smaller fluid tank would significantly facilitate the handling of the circuit breaker, for example, during installation and maintenance. In addition, it is also desirable to reduce the manufacturing cost of the circuit breaker by reducing the number of parts used for assembling the conventional circuit breaker. Moreover, afer frequent exposure to arcs, a carbon layer is formed along the length of the elongated bore 24. Due to the conductive property of the carbon layer, the insulating property of the bore 24 may diminish, resulting in early failure of the circuit breaker 10.

Therefore, there exists a need for a small and durable primary circuit breaker that can be manufactured cost effectively.

SUMMARY

Briefly, the present invention is embodied in an interrupt assembly for a circuit breaker, preferably a primary circuit breaker for a distribution transformer, that breaks a high-voltage electrical path between two breaker contacts. The interrupt assembly includes an elongated housing with surrounding walls that are used for holding an insulating fluid formulated for extinguishing a generated arc. The elongated housing is divided into separate chambers by one or more rigid dividers, for example, dividers made of a bone fiber material, such that each chamber encapsulates the insulating fluid between the surrounding walls and at least one divider. A conductive rod that is reciprocally movable within the chambers breaks the electrical path under a fault condition. In an exemplary arrangement, the dividers include corresponding openings through which the conductive rod moves within the chambers.

According to some of the more detailed features of the present invention, the elongated housing of the interrupt assembly includes a plurality of detachable housing sections, including a top section and a bottom section, with at least one of the sections having a groove for holding a divider. Preferably, the interrupt assembly of the present invention has a modular design where one or more center sections may be positioned between the top and bottom section to vary the length of the elongated housing.

According to other more detailed features of the present invention, the housing of the interrupt assembly has surrounding walls, including a top wall, a peripheral side wall, and a bottom wall. The top and peripheral side walls include openings that allow the expanding gases produced by the insulating fluid to rapidly exit the interrupt assembly.

Other features and advantages of the present invention will become apparent from the following description of the preferred embodiment, taken in conjunction with the accompanying drawings, which illustrate, by way of example, the principles of the invention.

DETAILED DESCRIPTION OF THE PREFERRED EMBODIMENT

Figure 2:
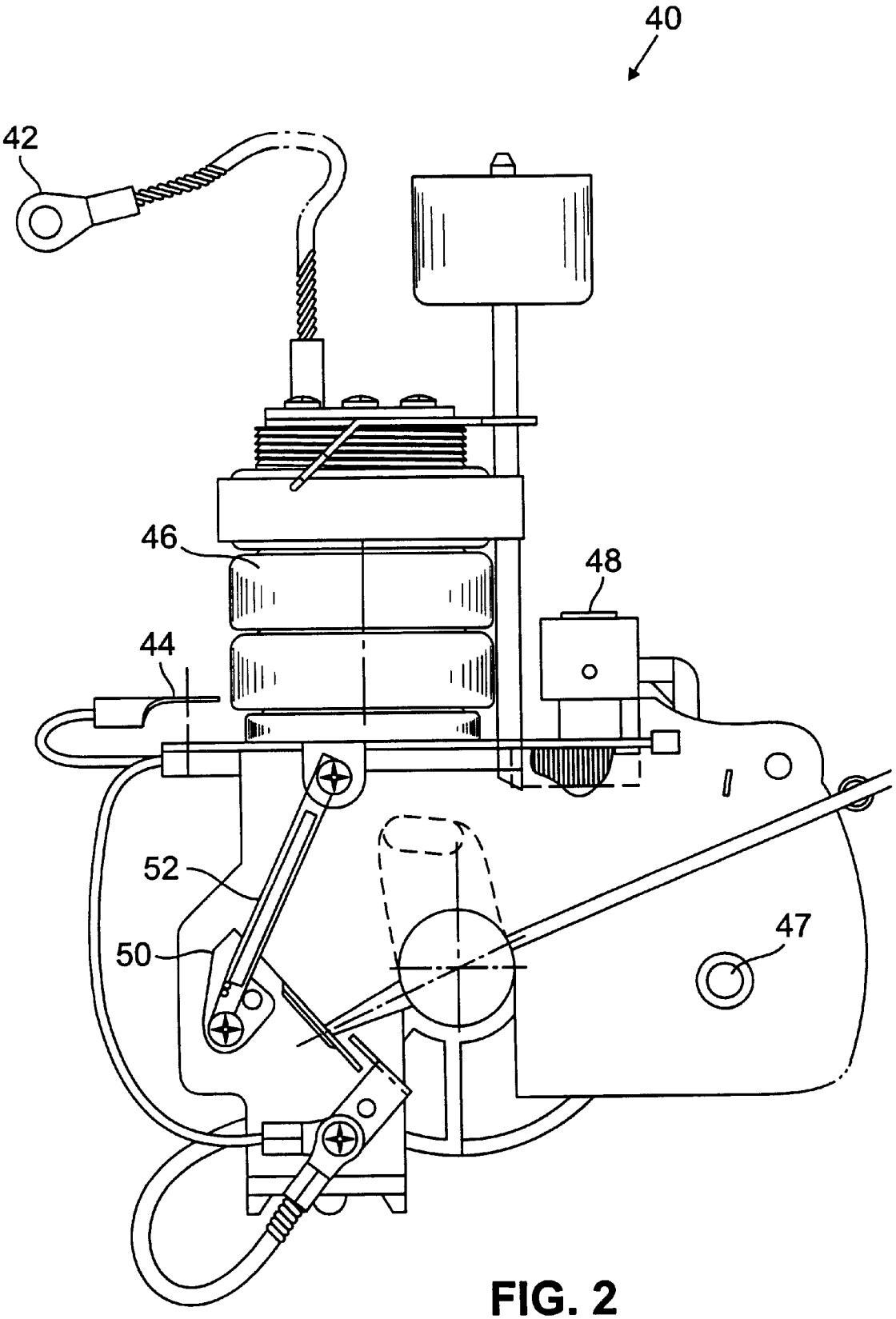
FIG. 2 is a side view of a circuit breaker according to the present invention.

Referring to FIG. 2, an exemplary circuit breaker 40 according to the present invention is shown. The circuit breaker 40 is a primary circuit breaker that breaks a high-voltage path at a primary side of a distribution transformer (not shown). The circuit breaker 40, which may be secured to the distribution transformer through a base or a frame 47, includes first and second breaker contacts 42 and 44 that are connected in series to a primary winding of the transformer. Through an interrupt assembly 46, the circuit breaker 40 provides an interruptible electrical path between the first and second breaker contacts 42 and 44. In a normally closed condition, an uninterrupted electrical path is provided by the circuit breaker 40, starting at the first breaker contact 42 and following through the interrupt assembly 46 to a temperature sensing assembly 48, finally terminating at the second breaker contact 44. In a fault condition, for example, when a fault current passes through the first and second breaker contacts 42 and 44, the temperature sensing assembly 48 responds to the fault condition by generating a trip signal. A latch mechanism 50 is responsive to the trip signal to interrupt the electrical path between the first and second contacts 42 and 44 through the interrupt assembly 46.

Figure 3:
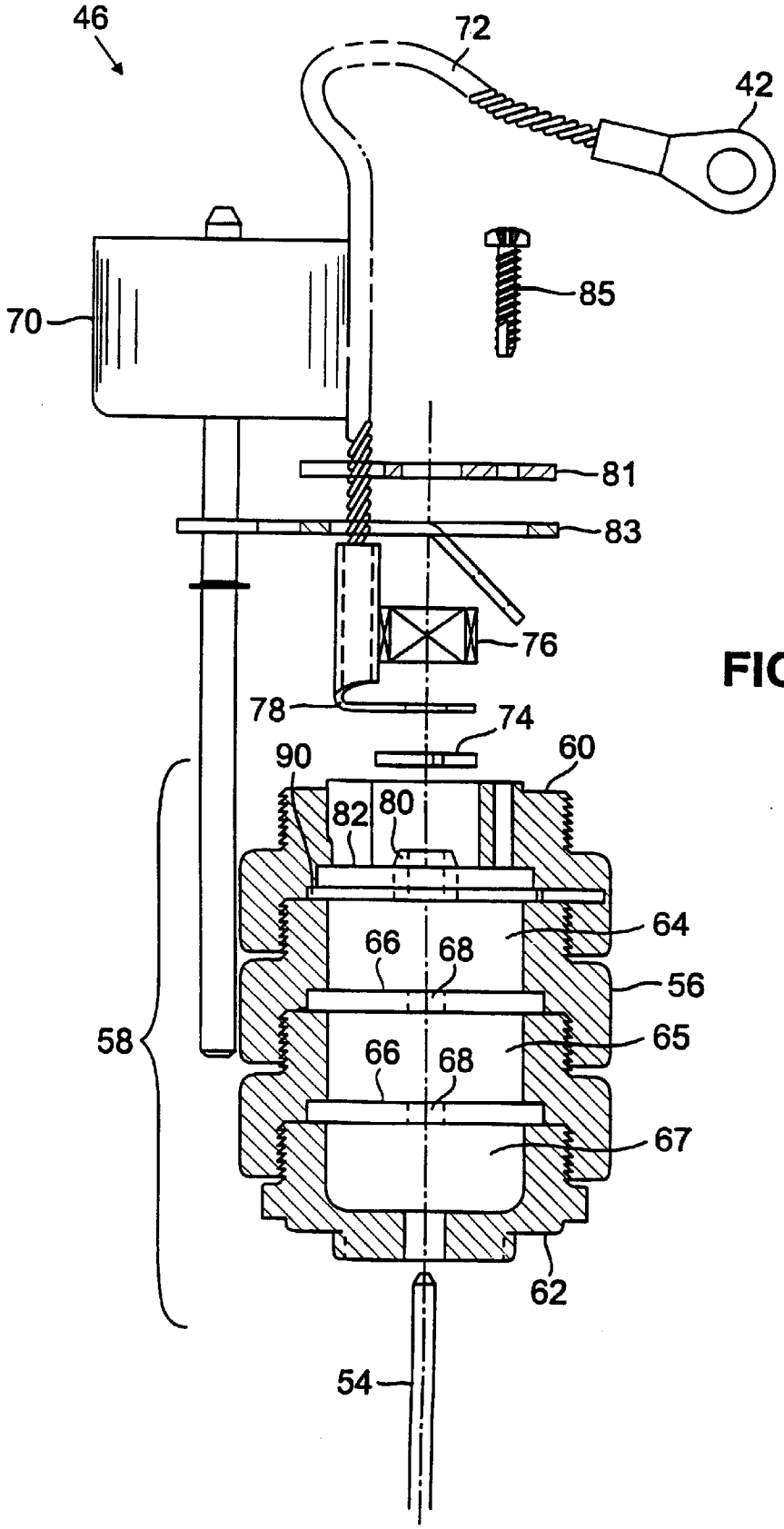
FIG. 3 is an exploded cross sectional view of an interrupt assembly for the circuit breaker of FIG. 2.

Referring to FIG. 3, an exploded view of the interrupt assembly 46 of the present invention is shown to include, among other things, an elongated housing 56 and a conductive rod 54 that in the normally closed condition, provides part of the electrical path between the first and second contacts 42 and 44. The elongated housing 56 has a number of surrounding walls that include a cylindrical peripheral side wall 58 substantially having a round flat top wall 60 and a round and flat bottom wall 62.

Figure 1:
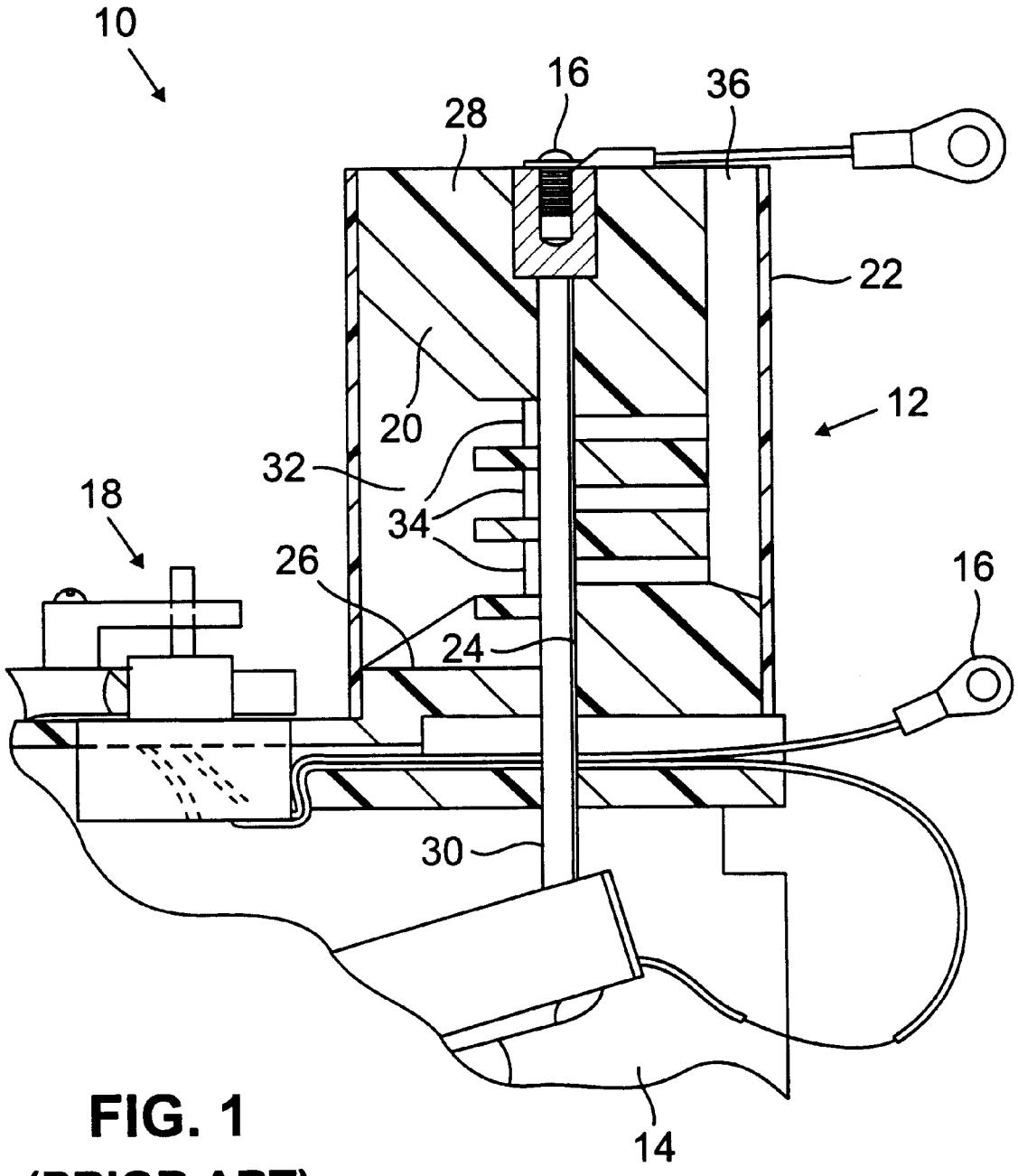
FIG. 1 (PRIOR ART)
FIG. 1 is a cross sectional view of a conventional primary circuit breaker.

Unlike the conventional interrupt assembly of FIG. 1, which has a single integrated arc-chamber 32, the elongated housing 56 of the present invention is divided into separate chambers by means of one or more dividers 66. The dividers divide the housing 56 into an upper chamber 64, one or more center chambers 65, and a lower chamber 67. When immersed in an insulating fluid, which enters the interrupt assemble 46 through the top and bottom walls 60 and 62, each chamber discretely encapsulates a portion of the insulating fluid between one or more of the surrounding walls and at least one divider. For example, the upper chamber 64 encapsulates the insulating fluid between the top wall 60, peripheral side wall 58, and one of the dividers 66. Whereas, the center chamber 65 encapsulates the insulating fluid between the peripheral side wall 58 and two dividers 66. Each divider 66 has an opening 68 through which the reciprocally movable conductive rod 54 travels. The openings 68 are sized to substantially surround the conductive rod 54, providing just enough room for its reciprocal movement. In a preferred embodiment, the dividers 66 are made of a bone fiber material, which is extremely rigid, thus, resistive to expanding gases that are produced by the heat of the generated arc. Also, the bone fiber material is resistive to the formation of carbon layers along the travel path of the conductive rod 54. However, other suitable materials may be used for the dividers.

As shown in FIG. 3, the first electrical contact 42 is provided by means of a cable assembly 72 that rests on a high-voltage contact 74. The high-voltage contact 74, which in the exemplary embodiment of the invention is made of a copper-tungsten alloy, e.g., 10W3 copper-tungsten, is a spring loaded contact that is positioned against the top plate or washer 81 via a spring 76. An electrical connection between the high-voltage contact 74 and the conductive rod 54 is provided by a conductive contact-ring 80 that is pressure fitted at the center of an upper divider 82, touching the high-voltage contact 74. Preferably, the conductive rod 54 has a tip also made of the copper-tungsten alloy, to prevent welding between the conductive rod 54 and high-voltage contact 74. One or more screws 85 secure a top-plate 81, which holds a crimped terminal 78 of the cable 72, as well as a floater-holding bracket 83, which holds a floater assembly 70, to the top wall 60.

Figure 4:
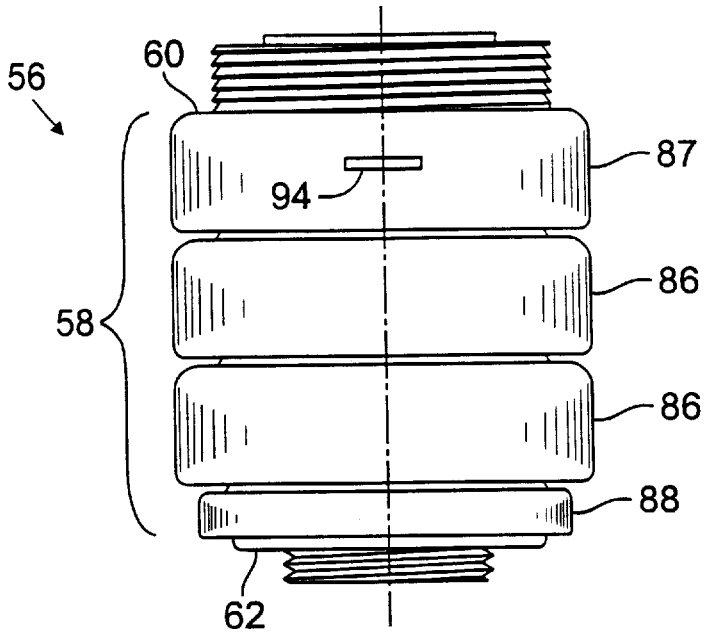
FIG. 4 is a side view of a housing for the interrupt assembly of FIG. 3.

Referring to FIG. 4, the housing 56 is an assembly having a number of cylindrical stacked sections, including a top section 87, one or more center sections 86, and a bottom section 88. Under this arrangement, the housing sections 86, 87, and 88, when attached, collectively provide the surrounding walls of the interrupt assembly 46, including the top wall 60, peripheral side wall 58, and bottom wall 62. Although the housing 56 may be made of a single integrated piece, according to one of the features of the present invention, the housing sections 86, 87 and 88 may be detachable from one another, thereby providing a modular housing design for the invention. As a result, the interrupt assembly 46 of the present invention may be configured to extinguish a generated arc based on the level of voltage on the electrical path. For example, for a very high voltage level, a higher number of center sections 86 may be stacked to extinguish a longer generated arc.

As described above, in the normally closed condition, the conductive rod 54 provides part of the uninterrupted electrical path between the breaker contacts 42 and 44 through the contact-ring 80 and the high-voltage contact 74. Conversely, in the fault condition, conductive rod 54 moves in a downwardly direction through each one of the chambers 64, 65 and 66, thereby breaking the electrical path between the first and second contacts 42 and 44. Consequently, an arc is generated between the tip of the conductive rod 54 and the high-voltage contact 74 through the contact-ring 80. As described later in detail, because each one of the chambers 64 separately the holds insulating fluid used for extinguishing the generated arc, the expanding gases are contained substantially within each one of the chambers, thereby increasing voltage handling of the circuit breaker 40.

According to another feature of the present invention, the interrupt assembly 46 allows for a substantially immediate exit of the expanding gases through openings positioned on the upper chamber 64 of the housing 56, near where a generated arc originates. Consequently, the expanding gases do not interfere with the dielectric property of the insulating fluid in the lower chambers, thus, causing the generated arc to be extinguished more rapidly.

Figure 6:
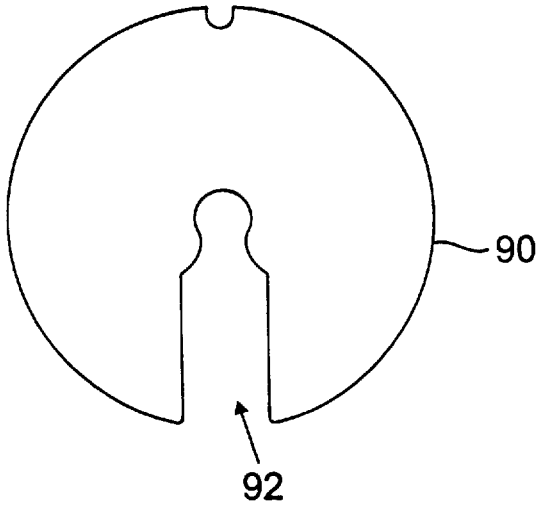
FIG. 6 is a top view of a guide piece used in the interrupt assembly of FIG. 3.
Figure 5:
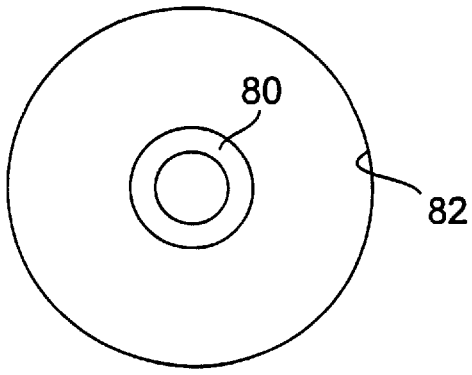
FIG. 5 is a top view of an upper divider used in the interrupt assembly of FIG. 3.

As shown in FIG. 3, the upper divider 82 rests on a thin guide-piece 90, which creates a slot 94 for directing the expanding gases to the upper side of the housing 56. A top view of the upper divider 82 is shown in FIG. 5, and a top view of the guide piece 90 is shown in FIG. 6. The guide piece 90, which may be made of the same material as the dividers 66, i.e., a bone fiber material, has a hollow guide section 92 that is aligned with the contact-ring 80 of the upper divider 82, thereby creating the slot 94, which in the exemplary embodiment, has an approximate dimension of $1/16^{th}$ by 3/8th of an inch. Furthermore, the top wall 60 of the housing 56 includes another opening that allows the expanding gases to exit from the top of the interrupt assembly 46 through a center opening of the contact-ring 80 and a center opening of the high-voltage contact 74.

Figure 7A:
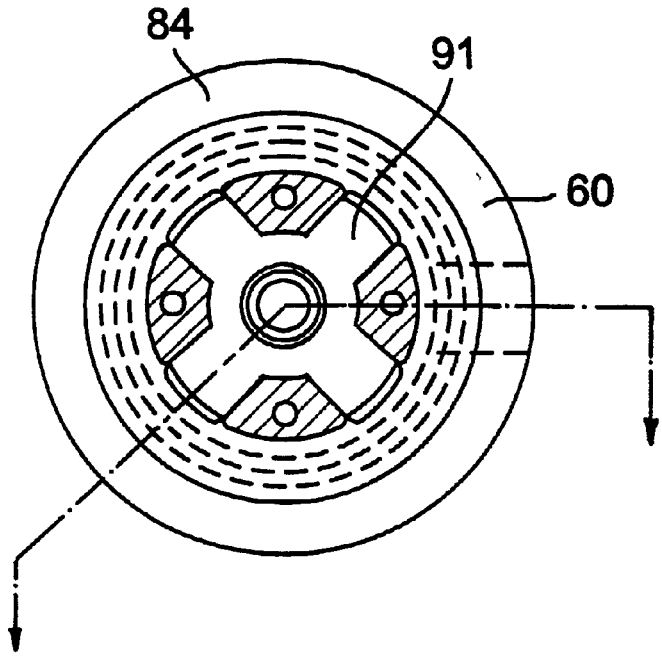
FIGS. 7(*a*)–7(*c*) are top, cross-sectional, and side views of a top section of the housing of FIG. 4, respectively.
Figure 7B:
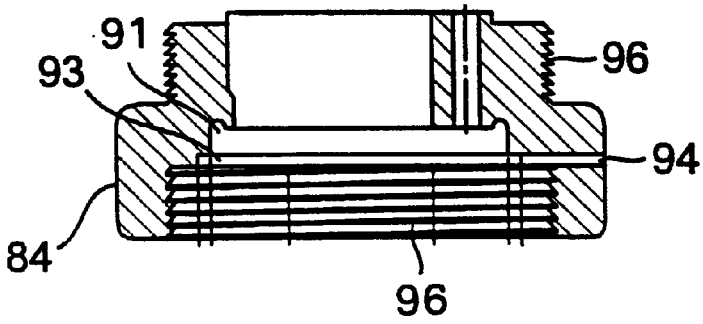
Figure 7C:
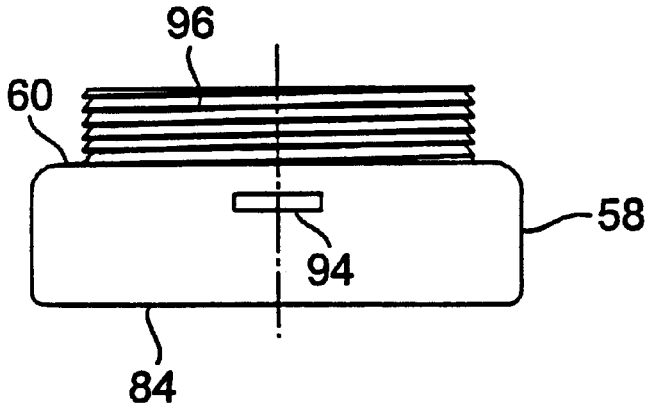

Referring to FIG. 7(*a*), the top view of the top section 84, which provides the top wall 60 and a portion of the peripheral side wall 58 of the housing 56, is shown. As shown, the top wall 60 includes an opening 91 that allows for the expanding gases to exit from the top side of the interrupt assembly 46. As shown in FIG. 7(*b*), which is a cross sectional view of the top section 84 along an A—A axis shown in FIG. 7(*a*), the slot 94 allows the expanding gases to exit from the upper side of the interrupt assembly 46. The top section 84 also includes threaded portions 96, allowing this section to be attached to another housing section, for example, a center section 86 or in case of a two-chamber arrangement, a bottom section 88. As shown, the top section 84 includes groove 91 and 93 for holding the upper divider 82 and the guide piece 90, respectively. FIG. 7(*c*) shows the side view of the top section 84 where the slot 94 is positioned.

Figure 8A:
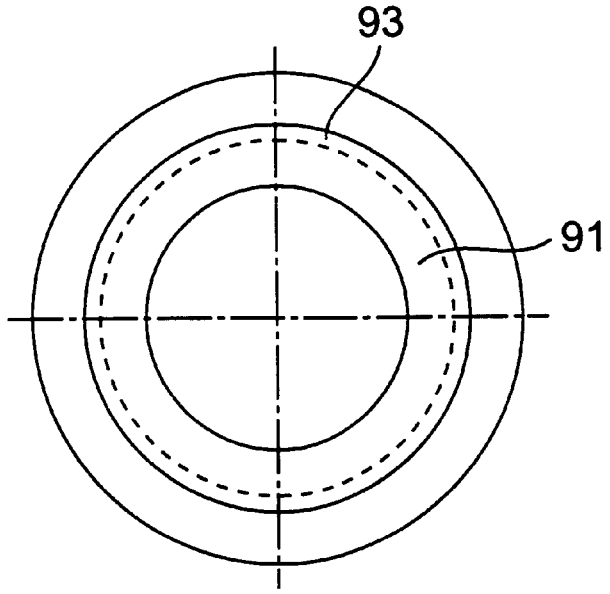
FIGS. 8(*a*)–8(*c*) are top, cross-sectional, and side views of a center section of the housing of FIG. 4, respectively.
Figure 8B:
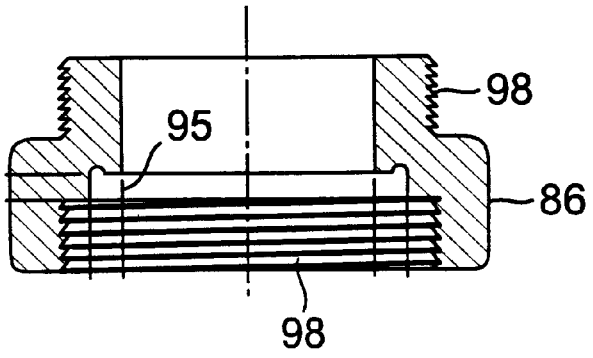
Figure 8C:
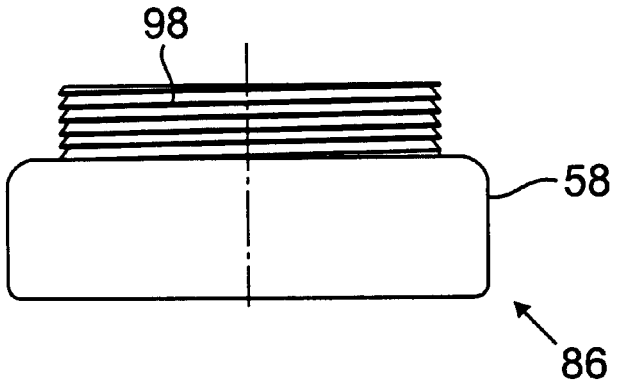

Referring to FIGS. 8(*a*), 8(*b*), and 8(*c*), top, cross sectional, and side views of a center section 86 are shown, respectively. As described before, one or more of the center sections 86 may be stacked as necessary to provide a suitable length for the housing 56. The center section 86 also has threaded portions 98 that allow it to be attached to other center sections as well as the top section 86 and bottom section 88. Similar to the top section 84, each center section 86 includes a groove 95 for holding a divider 66, such that, when threaded to another section, the divider 66 divides the housing 56 into separate chambers.

Figure 9A:
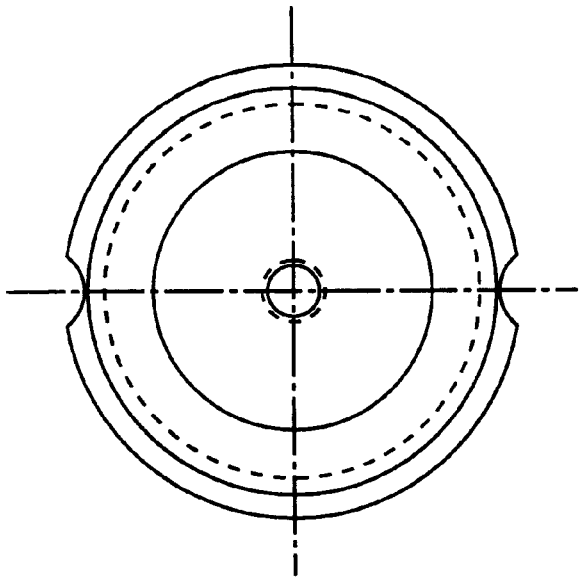
FIGS. 9(*a*)–9(*c*) are top, cross-sectional, and side views of a bottom section of the housing of FIG. 4, respectively.
Figure 9B:
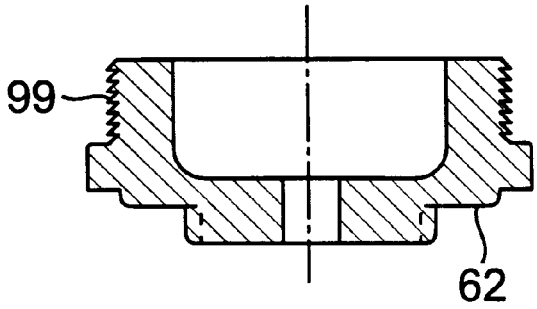
Figure 9C:
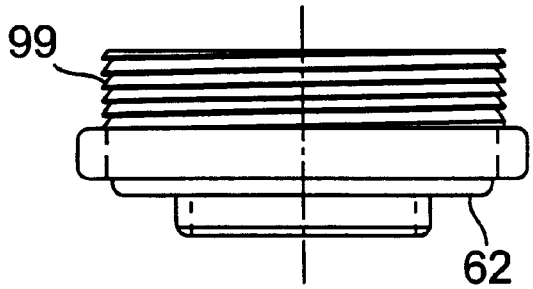

FIGS. 9(*a*), 9(*b*), and 9(*c*), show top, cross sectional, and side views of bottom section 88, respectively. The bottom section 88, which provides the bottom wall 62 of the housing 56, also includes threaded portions 99, allowing it to be attached to the center section 86 or the top section 84.

Operationally, in the normally closed condition the conductive rod 54 is in contact with the contact-ring 80. As soon as a fault condition is indicated, the conductive rod 54 starts to travel downwardly and breaks contact with the contact-ring 80, generating an arc. The resulting expanding gases pressure the spring loaded high-voltage contact 74 against the top wall 60, allowing the gases to exit from the top of the interrupt assembly 46 through the center openings of the contact-ring 80 and high-voltage contact 74.

In the meantime, the insulating fluid in the upper chamber 64 rushes in between the conductive rod 54 and the contact ring 80, presenting increased dielectric strength to extinguish the arc. As the expanding gases exit from the side and top of the interrupt assembly 46, more insulating fluid fills in from the bottom, while the conductive rod 54 continues to rapidly move downward into a lower chamber. Because the housing 56 of the present invention is divided into separate chambers by the dividers 66, which keep the gas from going down to the next chamber even under strong pressure, it becomes difficult for the expanding gases to travel from an upper chamber into a lower chamber. As a result, fresh insulating fluid encapsulated in a lower chamber presents an even stronger dielectric property to the generated arc, as the arc travels into the lower chamber. Because of the presence of the strong dielectric along the path of a generated arc, the interrupter assembly 46 of the present invention can extinguish the arc rapidly, resulting in a higher voltage path handling compared to the conventional circuit breaker.

From the foregoing description, it will be appreciated that the interrupt assembly of the present invention has a smaller size compared to the conventional assembly. Also, because of its modular design, the interrupt assembly of the present invention may be manufactured cost effectively using less parts. Furthermore, because the conductive rod is guided through the chambers without an elongated bore, unlike the conventional design, the risk of carbonizing any sections of the interrupt assembly is minimized.

Although the invention has been described in detail with reference only to a preferred embodiment, those skilled in the art will appreciate that various modifications can be made without departing from the invention. Accordingly, the invention is defined only by the following claims which are intended to embrace all equivalents thereof.

What is claimed is:

1. An interrupt assembly for a circuit breaker that breaks an electrical path between a first contact and a second contact, the assembly comprising:

a housing elongated in a first direction, having detachable housing sections positioned along the first direction, and defining surrounding walls for holding an insulating fluid, wherein each housing section defines a chamber;

one or more planar dividers spaced along the first direction to divide the elongated housing into chambers corresponding to the housing sections such that each chamber encapsulates a respective quantity of insulating fluid between the surrounding walls and at least one divider; and a conductive rod that is reciprocally movable along the first direction within the chambers for breaking the electrical path between the first contact and the second contact.

2. The interrupt assembly of claim 1, wherein the housing sections include at least a top section and a bottom section.

3. The interrupt assembly of claim 2, wherein the housing sections include one or more center sections positioned between the top section and the bottom section.

4. The interrupt assembly of claim 1, wherein at least one of the housing sections includes a groove for holding a divider.

5. The interrupt assembly of claim 1, wherein the one or more dividers include corresponding openings through which the conductive rod moves along the first direction within the chambers.

6. The interrupt assembly of claim 5, wherein the corresponding openings are sized to surround the conductive rod while providing sufficient clearance to permit reciprocal movements of the conductive rod.

7. The interrupt assembly of claim 1, wherein the surrounding walls of the housing include a top wall, a peripheral side wall, and a bottom wall.

8. The interrupt assembly of claim 7, wherein the top wall includes an opening for the exit of expanding gases produced by the insulating fluid.

9. The interrupt assembly of claim 7, wherein the peripheral side wall includes an opening for the exit of expanding gases produced by the insulating fluid.

10. The interrupt assembly of claim 1, wherein the one or more dividers are made of a bone fiber material.

11. The interrupt assembly of claim 1, wherein:

the chambers include a first chamber and a second chamber, the first contact is located in the first chamber and electrically isolated from the second chamber when the electrical path is broken, and the second contact is electrically isolated from the first chamber when the electrical path is broken.

12. The interrupt assembly of claim 1, wherein the one or more dividers extend from at least one of the surrounding walls of the elongated housing.

13. The interrupt assembly of claim 7, wherein the one or more dividers extend from the peripheral side wall of the housing.

14. The interrupt assembly of claim 1, wherein each housing section defines a wall generally perpendicular to the one or more planar dividers.

15. The interrupt assembly of claim 14, wherein each housing section defines a generally cylindrical wall.

16. The interrupt assembly of claim 1, wherein each housing section defines a generally cylindrical wall.

17. The interrupt assembly of claim 1, wherein the housing sections are configured to extinguish a generated arc based on the level of voltage in the electrical path.

18. The interrupt assembly of claim 17, wherein configuring the housing sections comprises selecting a number of housing sections to include in the elongated housing.

19. The interrupt assembly of claim 1, wherein the insulating fluid comprises an insulative oil.

20. The interrupt assembly of claim 19, wherein the insulative oil comprises a dielectric that is formulated for breaking the electrical path between the first and second contacts.

21. A circuit breaker that breaks an electrical path between a first contact and a second contact, the circuit breaker comprising:

a first chamber that encapsulates a first quantity of insulating fluid formulated to extinguish an arc generated by breaking the electrical path;

a second chamber that encapsulates a second quantity of insulating fluid; and a conductive rod that is movable within the first and second chambers for breaking the electrical path between the first contact and the second contact, wherein:

the first contact is located in the first chamber and electrically isolated from the second chamber when the electrical path is broken, the second contact is electrically isolated from the first chamber when the electrical path is broken, and the first chamber is detachable from the second chamber.

22. The circuit breaker of claim 21, wherein the one of the first or second chambers includes an opening for allowing expanding gases caused by the arc to exit the circuit breaker.

23. The circuit breaker of claim 21, wherein the first chamber is separated from the second chamber by a divider that includes an opening through which the conductive rod moves within the first and second chambers.

24. The circuit breaker of claim 23, wherein the corresponding openings are sized to surround the conductive rod while providing sufficient clearance to permit reciprocal movements of the conductive rod.

25. The circuit breaker of claim 23, wherein the divider is made of a bone fiber material.

26. The circuit breaker of claim 21, wherein the first and second chambers, when attached, provide surrounding walls, including a top wall, a peripheral side wall and a bottom wall.

27. The circuit breaker of claim 26, wherein the peripheral side wall includes an opening for allowing expanding gases to exit the circuit breaker.

28. The circuit breaker of claim 26, wherein the top wall includes an opening for allowing expanding gases to exit the circuit breaker.

29. The circuit breaker of claim 23, wherein the divider is planar.

30. The circuit breaker of claim 23, further comprising a housing including a top wall, a peripheral side wall, and a bottom wall, wherein the divider extends from the peripheral side wall.

* * * * *